US005815121A

United States Patent [19]

Collier

[11] Patent Number: 5,815,121

[45] Date of Patent: Sep. 29, 1998

[54] FLATPLATE ARRAY ANTENNA WITH POLARIZER LENS

[75] Inventor: Donald C. Collier, Newtown, Conn.

[73] Assignee: Northrop Grumman Corporation, Los Angeles, Calif.

[21] Appl. No.: 827,768

[22] Filed: Apr. 11, 1997

Related U.S. Application Data

[63] Continuation of Ser. No. 529,257, Sep. 15, 1995, abandoned.

[51] Int. Cl.[6] ..... H01Q 15/24

[52] U.S. Cl. ..... 343/756; 343/909

[58] Field of Search ..... 343/756, 909; H01Q 15/24

[56] References Cited

U.S. PATENT DOCUMENTS

| | | | |
|---|---|---|---|
| 4,063,249 | 12/1977 | Bergander et al. | 343/756 |
| 4,266,203 | 5/1981 | Saudreau et al. | 343/756 |

OTHER PUBLICATIONS

Leslie M. Novak et al. "Optimal Polarization for Radar Detection and Recognition of Targets in Clutter," 1993 *IEEE*, pp. 79–83 no month.

Leo Young et al. "Meander–Line Polarization," *IEEE Transaction on Antennas and Propogation*, May, 1973.

Howard A. Zebker, et al. "Imaging Radar Polarimetry From Wave Synthesis," *Journal of Goographical Research*, vol., 92, No. B1, pp. 683–701, Jan. 10, 1987.

*Primary Examiner*—Michael C. Wimer
*Attorney, Agent, or Firm*—Walter G. Sutcliff

[57] ABSTRACT

An improved flatplate array antenna has a polarizer lens positioned adjacent the array. The polarizer lens is made of at least one dielectric sheet having an upper half and a lower half. Each half contains a set of parallel meanderlines positioned so that vertically or horizontally polarized RF energy emitted from the array passes through the lens and undergoes a phase advance or a phase retard, so that the RF energy passing through the upper half becomes circularly polarized in one direction and the RF energy passing through the lower half becomes circularly polarized in an opposite direction.

15 Claims, 5 Drawing Sheets

FIG. 1
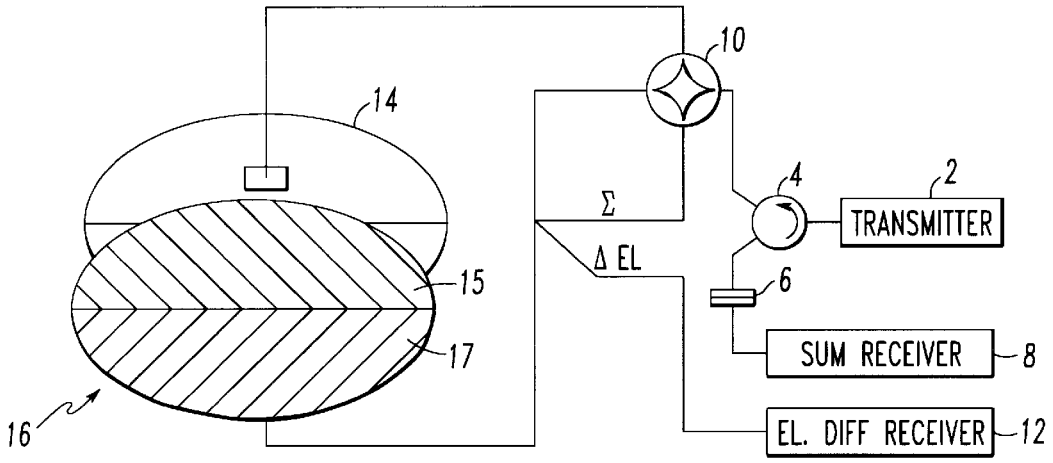
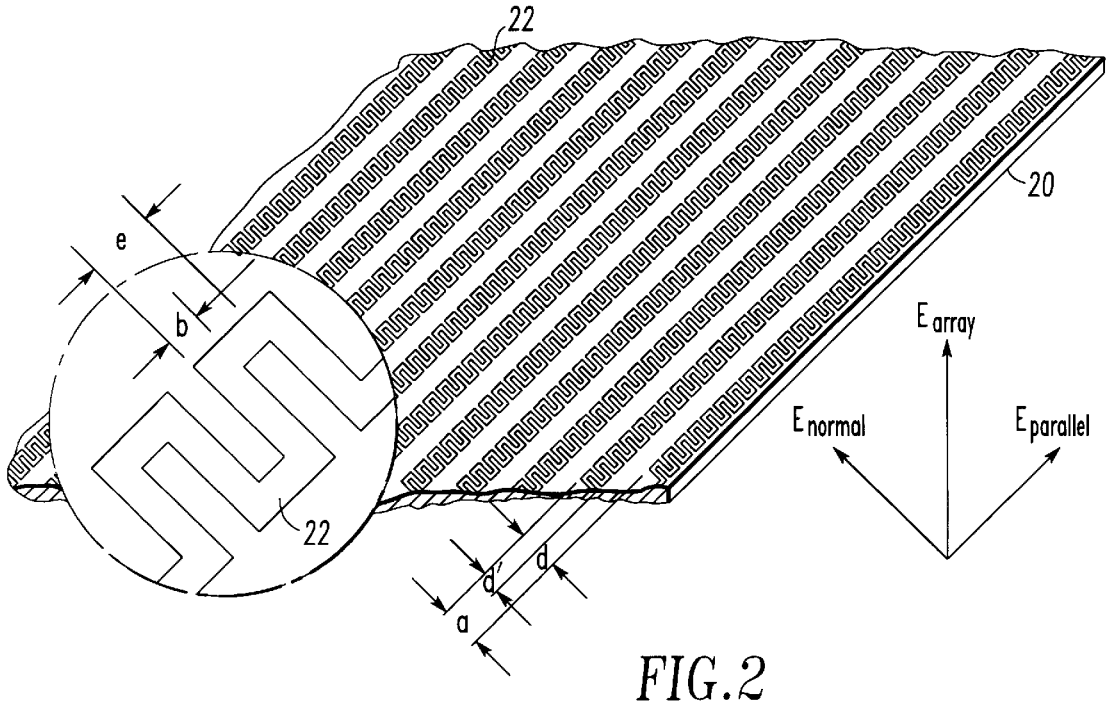
FIG. 2

FIG.3
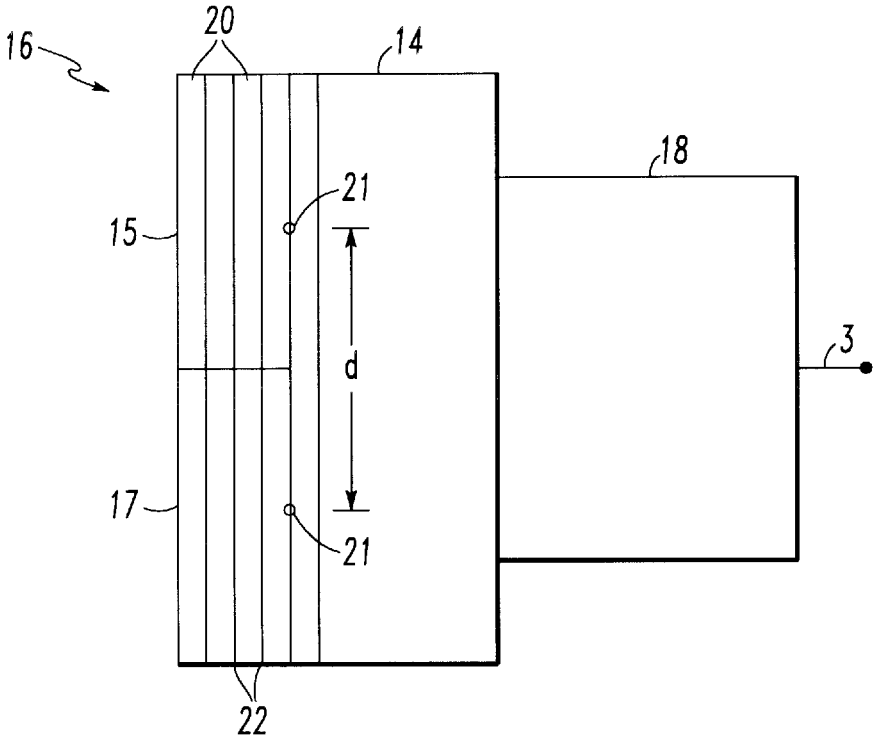
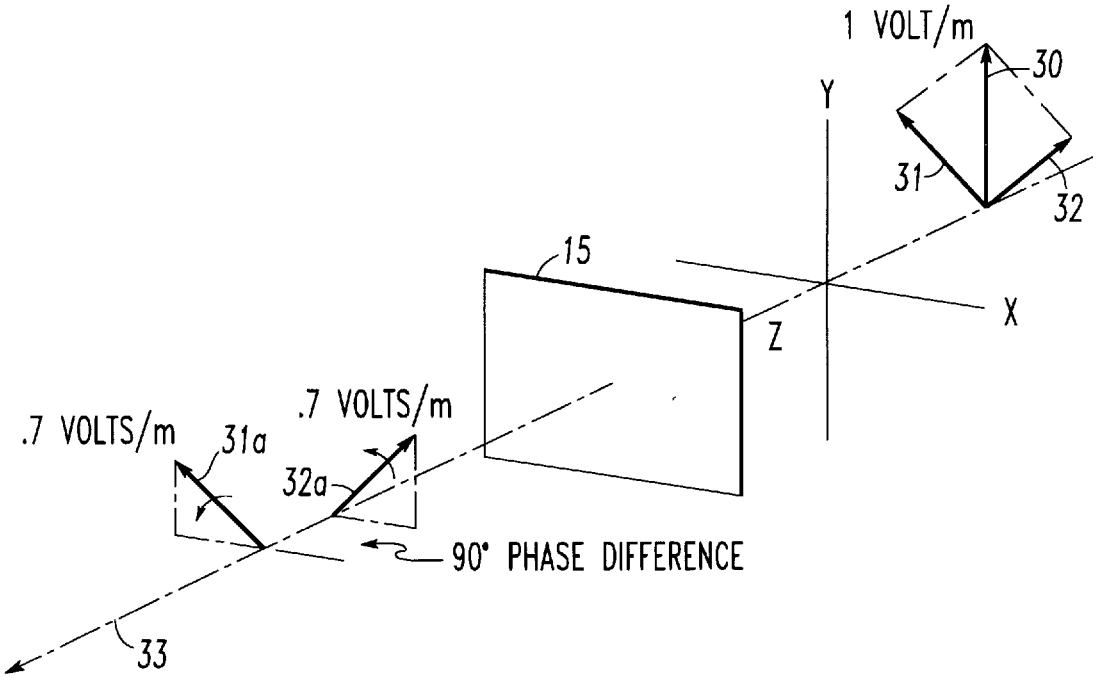
FIG.4

FIG.8
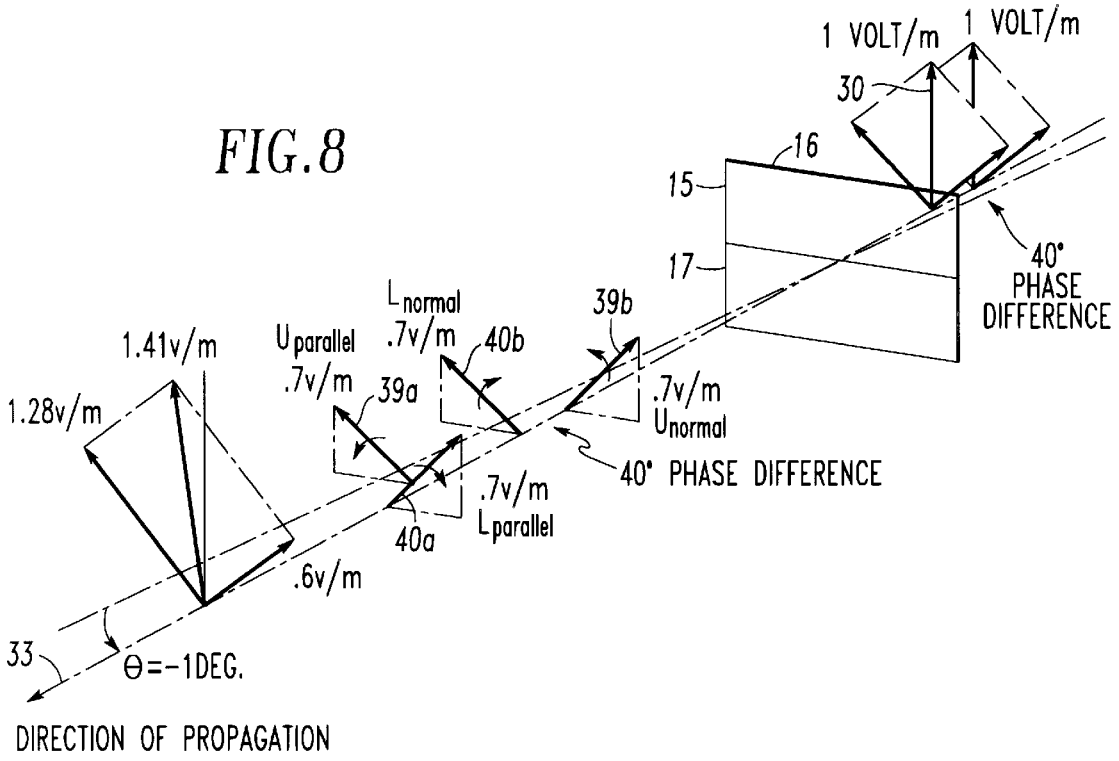
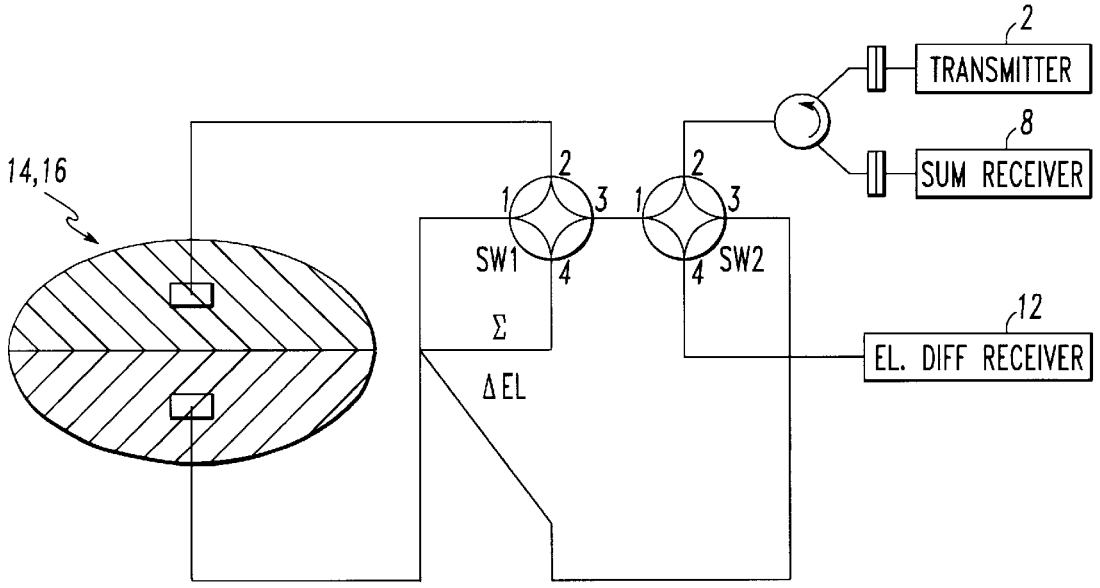
FIG.9

FLATPLATE ARRAY ANTENNA WITH POLARIZER LENS

This is a continuation of application Ser. No. 08/529,257, filed Sep. 15, 1995, now abandoned.

FIELD OF INVENTION

The invention relates to an array antenna for transmitting and receiving linearly polarized and circularly polarized RF energy.

BACKGROUND OF THE INVENTION

Successfully recognizing specific tactical targets from an airborne platform a high percentage of the time has the direct benefit of reducing fratricide and increasing the overall aircraft mission effectiveness. The need to recognize these targets at night and under all weather conditions has led to the development of various advanced radar techniques designed to measure unique characteristics or features of the target signatures. Features of special interest have included target size (or signal intensity), target shape, target motion, target Doppler frequency modulations, and target polarization properties.

Long-range, all-weather airborne radar systems, capable of sensing both the target size and shape, are now feasible, given the ultra-fine resolution capabilities of modern tactical radars such as the AN/APG-76 radar system produced by Westinghouse Norden Systems. Overall target motion can be sensed by any of several different MTI-based systems, although Displaced Phase Center systems have been shown to be much more effective than other techniques in detecting slow speed targets that are moving in high ground clutter environments. Fine-grain Doppler modulations observed on ground moving targets have also been used effectively to discriminate between tracked and wheeled vehicles.

Despite these various radar discriminants, a number of studies have shown that the probability of correct classification can be significantly improved by introducing polarization as an additional target identifier. Lincoln Laboratories, for example, has published widely on the utility of polarization to reduce speckle or coherent noise. In addition, spatial filtering in combination with polarization "whitening" has yielded extremely low false alarm rates and high probabilities of target detection.

Many existing radar antennas are linearly polarized, usually either vertically or horizontally. Radar systems that utilize both vertical polarization and horizontal polarization have separate antennas which generate either only vertically polarized radar pulses or only horizontally polarized radar pulses.

Some radars use circular polarization in order to detect aircraft-like targets in rain. In that case, the direction of the E-field varies with time at any fixed observation point, tracing a circular locus once per RF cycle in a fixed plane normal to the direction of propagation. Two senses of circular polarization are possible, right-hand and left-hand. By reciprocity, an antenna designed to radiate a particular polarization will also receive the same polarization.

Because circular polarization and linear polarization have advantages over one another, a radar system which provides both circular polarization and linear polarization is desirable. Yet, under the current state of the art such a system would require four separate antennas. Prior to the present invention the art had not developed a radar antenna which combines both linear polarization and circular polarization.

SUMMARY OF THE INVENTION

I provide an improved flatplate array antenna for transmitting and receiving RF signals which has a polarizer lens positioned adjacent the array. The lens is made of at least one dielectric sheet having an upper half and a lower half. Each half contains a set of parallel meanderlines positioned so that all vertically or horizontally polarized RF energy emitted from the array passes through the lens. The components of the polarization vectors undergo a phase advance or a phase retard, depending on their positions relative to the meanderlines. In that way RF energy passing through the upper half becomes circularly polarized in one direction and the RF energy passing through the lower half becomes circularly polarized in an opposite direction.

I further provide one or two RF switches for use with the polarizer lens in a synthetic aperture radar system to enhance radar performance. This radar system can be used for sensing either the full polarimetric target signature or various partial polarimetric target characteristics.

Other objects and advantages of a radar system having my RF switch and polarizer lens configuration will become apparent from a description of certain present preferred embodiments shown in the drawings.

BRIEF DESCRIPTION OF THE DRAWINGS

FIG. 1 is a simplified RF schematic of my flatplate array antenna with polarizer lens connected to a monopulse radar system of the prior art.

FIG. 2 is a perspective view, partially magnified, of a dielectric sheet showing details of the meanderlines used in the polarizer lens.

FIG. 3 is an unscaled side view of a flatplate array antenna to which my polarizer lens is attached.

FIG. 4 is a diagram showing propagation of a vertically polarized radar signal with orthogonal components through the upper half of the polarizer lens, on boresight.

FIG. 8 is a diagram showing propagation through the polarizer lens of vectors having a 40 degrees phase difference as a consequence of being radiated from upper and lower halves of an array 1 degree off center axis.

FIG. 9 is a simplified RF schematic of my flatplate array antenna with polarizer lens connected through a pair of RF switches to a monopulse radar system of the prior art.

DESCRIPTION OF THE PREFERRED EMBODIMENTS

Figure 5:
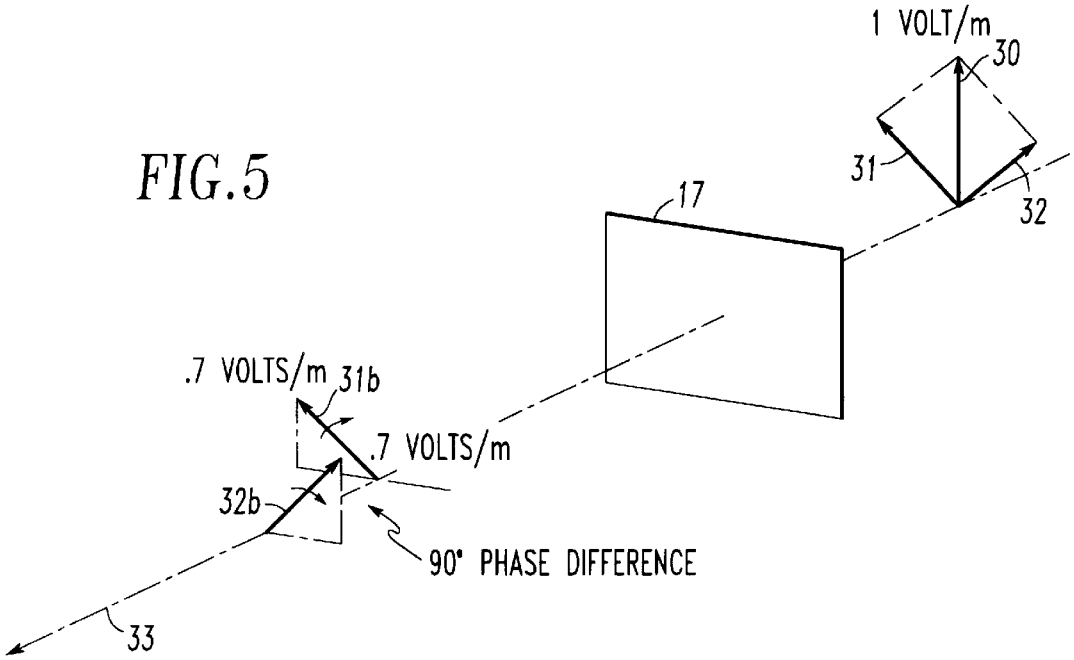
FIG. 5 is a diagram showing propagation of a vertically polarized radar signal with orthogonal components through the lower half of the polarizer lens, on boresight.

For optimum operation in an automatic target classification environment, Synthetic Aperture Radar (SAR) requires measurement of the target's polarimetric response; i.e., transmission of polarized RF energy and the reception simultaneously of copolarized and cross-polarized target echoes. To date, polarimetric SAR has been practical only when separate apertures were employed. However, I have found that a single array can be used if an RF switch and polarizer lens are provided as shown in FIG. 1. In that embodiment transmitter 2 is isolated by circulator 4 from sum flange 6 and sum receiver 8. It is connected to RF transfer switch 10. An elevation difference receiver 12 is also provided. When the RF switch is positioned as shown by the solid lines in FIG. 1, a signal from the transmitter will be evenly split and delivered to both upper and lower halves of flatplate array or other aperture 14 and polarizer lens assembly 16. The polarizer lens assembly 16 is comprised of a set of dielectric sheets 20 containing meanderlines 22, one of which sheets is shown in FIG. 2. As can be seen in FIG. 3, the lens assembly 16 is glued to the front of the antenna array 14 covering the monopulse aperture. The lens assembly 16 has two polarizer lenses 15 and 17. One lens 15, which produces right-hand circular polarization, covers the upper half of the antenna 14. The other lens 17, which produces left-hand circular polarization, covers the lower half of the antenna 14. Each half of the array has a phase center 21 located as shown in FIG. 3 at a distance d apart from one another. The structure can be built as shown in FIG. 3 to have a feed manifold 18 and transmitter port 3 to which the transmitter is connected. The circulator, RF switch, and receivers are not shown in this drawing.

Polarization modifying gratings or lenses were designed and built in the 1940's. They typically have several printed circuit sheets with a series of copper etched meanderlines which enable the lens to convert linear to circular polarization. The etched meanderlines used in this application are similar to the design outlined by Young, Robinson and Hacking in their article "Meander-Line Polarizer" in *IEEE Transactions on Antennas and Propagation,* May 1973. The layout is shown in FIG. 2, in which microstrip meanderlines 22 set at a 45-degree angle are etched into copperclad dielectric sheets 20.

Vertically polarized RF energy emitted from the array slots impinges on the polarizer sheet, located approximately 0.5 inches in front of the antenna aperture. As illustrated in FIG. 2, the radiated voltage vector $E_{array}$ consists of two components or legs, one parallel to the etched meanderline strips, $E_{parallel}$, and one perpendicular to the etched meanderline strips, $E_{normal}$. As $E_{normal}$ passes through the lens, it undergoes a phase retard, since the lens acts as a capacitive reactance to this leg of the RF signal. The admittance is determined by the etched meanderline dimensions:

$$\frac{B_c}{Y_0} \approx \frac{4a}{\lambda}\left[\ln\left(\frac{2a}{\pi d}\right)+\frac{1}{2}\left(\frac{a}{\lambda}\right)^2\right] \quad \text{(Eq. 1)}$$

where $B_C/Y_O$ is the normalized lens capacitive susceptance, the dimensions a and d' are shown in FIG. 2, and λ is the RF wavelength. The phase retard is then found:

$$\Phi_D = -2\tan^{-1}\left(\frac{B_c}{2Y_0}\right)\text{ degrees.} \quad \text{(Eq. 2)}$$

In similar manner, the vector $E_{parallel}$ undergoes a phase advance, since the lens acts as an inductive reactance to this leg of the RF vector. The reactance is approximately $$\frac{X_L}{Z_0} \approx \frac{a}{\lambda}\left[\ln\left(\frac{2a}{\pi d'}\right)+\frac{1}{2}\left(\frac{a}{\lambda}\right)^2\right] \quad \text{(Eq. 3)}$$

where $X_L/Z_O$ is the normalized lens inductive reactance, d' is shown in FIG. 2 and the other variables are the same as in Eq. 1. The phase advance is then $$\Phi_D = 2\tan^{-1}\left(\frac{B_L}{2Y_0}\right)\text{ degrees} \quad \text{(Eq. 4)}$$

where $$\frac{B_L}{Y_0} = \frac{Z_0}{X_L}.$$

An inaccuracy is introduced in this result by a reactance caused by the capacitance existing between parallel strips of each individual meanderline. From FIG. 2, the dimensions b and e can be substituted into Eq. 1, the phase retard calculated, and the result subtracted from the solution of Eq. 4.

The full 90-degree phase differential is not normally achieved with a single layer. The structure must be matched to free space to minimize RF reflections, so that three or more layers are used in the manner of spatial filters, each one shifting the RF phase a fraction of the desired total. When the full 90-degree separation between vector components has been obtained, the linearly polarized RF energy becomes circular by definition.

Vertically polarized RF is emitted from the flatplate array slots at 0 deg. elevation angle. The circularly polarized lens causes the vector components to undergo a phase advance if the vector component is parallel to the meanderlines. The vector component undergoes a phase retard if the vector component is normal to the meanderlines. This is illustrated in FIGS. 4 and 5. As there shown, a vertically oriented vector 30 with orthogonal components 31 and 32 is radiated from the antenna to travel along the direction of arrow 33 which corresponds to a Z axis. The polarized vector passes through the upper half 15 or the lower half 17 of the polarizer lens, which results in vectors 31*a* and 32*a* or 31*b* and 32*b* as shown. These resulting vectors will have a 90-degree phase difference and lower voltage.

In general, a linearly polarized electromagnetic wave propagating through space along the Z axis may be characterized in the time domain in the following manner:

$$\bar{E}=E_x\sin(\omega t=\psi)i=E_y\sin(\omega t=\psi)j$$

where ψ is the phase distance from the wave source and ωt is the instantaneous angular displacement over time.

The pair of rotating vectors illustrated in FIG. 4 have passed through the upper lens and may then be expressed in time and space by the equation (Eq. 5)

$$\bar{E}_{upper}=E_1[-.5\sin\omega t=45^\circ)i=.5\sin(\omega t=45^\circ)j=.5\sin(\omega t-45^\circ)i=.5\sin(\omega t-45^\circ)j]$$

where $E_1$=1volt/m. and i and j are unit vectors along the X and Y axes, respectively.

The pair of rotating vectors in FIG. 5 have passed through the lower lens and may be expressed in time and space by the equation (Eq. 6):

$$\bar{E}_{lower}=E_2[.5(\omega t=45^\circ)i=.5\sin(\omega t=45^\circ)j=.5\sin(\omega t=45^\circ)i=.5\sin(\omega t=45^\circ)j]$$

where $E_2$=1 volt/m. and i and j are unit vectors along the X and Y axes, respectively.

Figure 6:
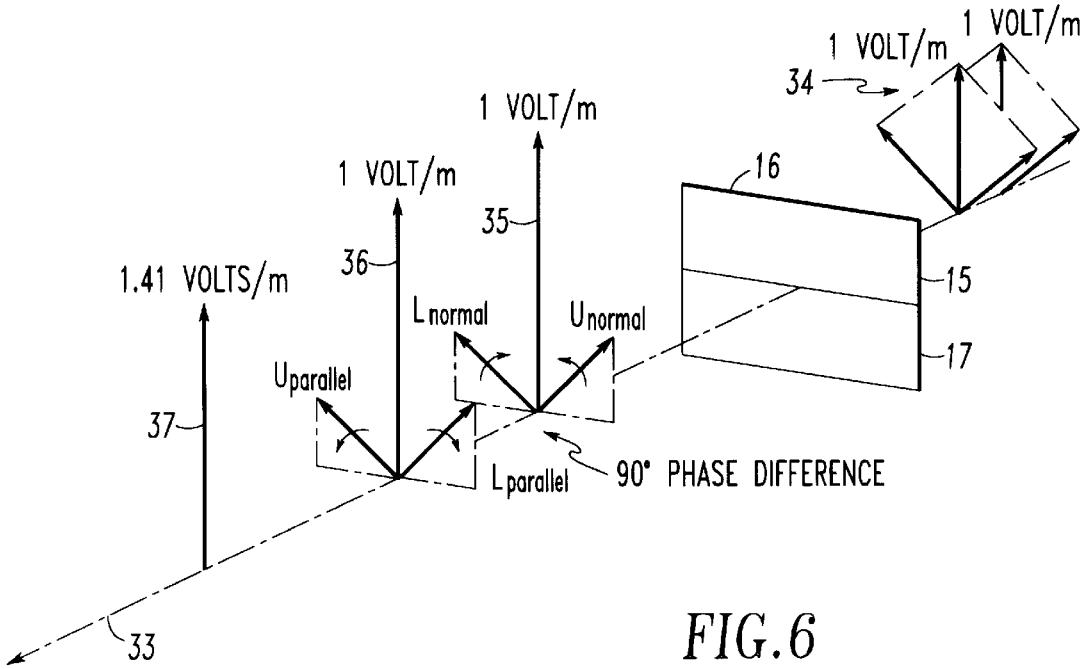
FIG. 6 is a diagram showing the vectors from the upper half of the array and the lower half of the array combining in the far field on boresight.

Referring now to FIG. 6 in phase vectors 34 travel on boresight along path 33 through meanderline polarizer lenses 16 and 17 resulting in vectors 35 and 36 at a 90-degree phase difference. Four rotating vector components, $U_{normal}$ and $U_{parallel}$ from the upper half and $L_{normal}$ and $L_{parallel}$ from the lower half of the array, combine in the far field to form resultant unified vector 37. On boresight then, the resultant RF polarization is linear vertical.

Performing mathematically what has been illustrated pictorially, Eq. 5 is added to Eq. 6. After some manipulation using trigonometric identities, the resultant total E-field is $$\overline{E}_t = 1.41\sin\omega t j v/m \quad (Eq.\ 7)$$

proving that the field resulting from the two apertures with circular polarization having contrary senses of rotation is vertical linear on boresight, since vertically polarized transmissions are denoted by the j term in each equation and horizontally polarized transmissions correspond to the i term in each equation.

However, energy has been lost along the boresight axis. For instance, if each half aperture emits 1 volt/m. or 1 watt/$m^2$ of vertically polarized RF, these vectors will combine in the far field as a vertically polarized vector of 1.41 volts/m. or 2 watts/$m^2$. Without the polarizer lens, each half aperture emits 1 volt/m, but since the upper and lower vectors are in phase, they would combine in the far field as 2 volts/m. or 4 watts/$m^2$. Use of the polarizer has therefore resulted in a one-way loss of −3 dB plus approximately 0.2 dB $I^2R$ ohmic losses.

Figure 7:
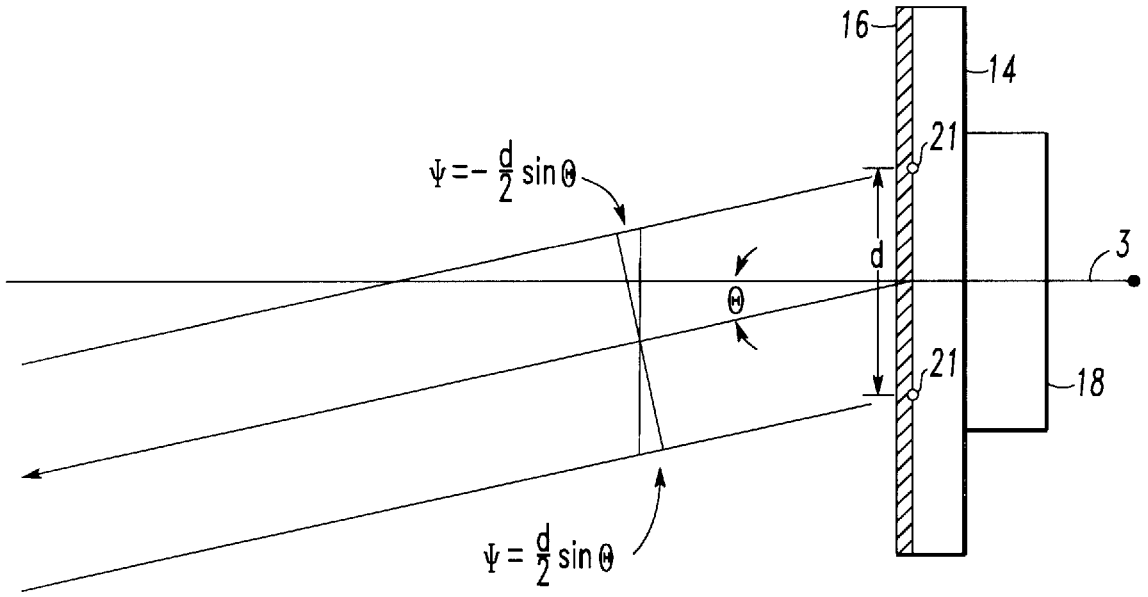
FIG. 7 is a diagram illustrating the spatial phase relationships in the elevational plane off boresight.

To consider the behavior of the RF voltage vector off boresight, a look at the more general far field equations provides a starting point. In FIG. 7, a side view of the array aperture reveals the phase relationships in the elevation plane. As an example, if θ were 1 degree below boresight and d=4.68 inches (6.5 wavelengths at the array operating frequency), the upper and lower half apertures would be spatially out of phase by d sin θ, or approximately 40 degrees, as shown in FIG. 8. The general time and space varying equation for any RF energy such as vector 38 passing through the polarizer lenses 16 and 17 to produce vectors 39 and 40 respectively in FIG. 8 on or off boresight would then be:

$$\overline{E}_{upper} = -.5\sin(\omega t-\psi+45°)i + .5\sin(\omega t-\psi+45°)j + .5\sin(\omega t-\psi-45°)i + .5\sin(\omega t-\psi-45°)j v/m \quad (Eq.\ 8)$$

$$\overline{E}_{lower} = .5\sin(\omega t+\psi+45°)i + .5\sin(\omega t+\psi+45°)j - .5\sin(\omega t+\psi-45°)i + .5\sin(\omega t+\psi-45°)j v/m \quad (Eq.\ 9)$$

From FIG. 8 it is apparent that the total RF energy transmitted off boresight will still be linearly polarized, but the resulting vector will have an orientation other than vertical. In fact, if both halves of the array transmit simultaneously, the combined vectors in the far field will always be linearly polarized, even though each half aperture is circularly polarized. By combining Eq. 8 with Eq. 9 and manipulating trigonometric identities, a general expression for the radiated RF energy is found:

$$\overline{E}_t = 1.41\sin\omega t\left[-\sin\left(\frac{d}{2}\sin\Theta\right)i + \cos\left(\frac{d}{2}\sin\Theta\right)j\right] v/m \quad (Eq.\ 10)$$

As the angle of depression is increased, the resultant far field vector will continue to rotate until it becomes horizontally polarized. Referring back to FIG. 7, this condition will occur when d sin θ is a half wavelength, or for the AN/APG-76 test aperture, when θ=−4.4 degrees. This prediction was borne out accurately in the far field patterns measured on the Norden compact range. Utilizing an approach similar to that used for the preceding mathematical development, it can be demonstrated that were the difference channel to transmit, the RF energy radiated would be expressed thus:

$$\overline{E}_t = 1.41\cos\omega t\left[-\cos\left(\frac{d}{2}\sin\Theta\right)i + \sin\left(\frac{d}{2}\sin\Theta\right)j\right] v/m \quad (Eq.\ 11)$$

In Eq. 10, the i term is zero when θ is zero on boresight, and the j term is maximum. The reverse is true for Eq. 11.

Table I summarizes the relative RF phase and amplitude in each channel according to the polarization of the returning radar signal.

TABLE I

| | Relative Amplitude and Phase of RF in Reciever Sum and Difference Channels | |
|---|---|---|
| | Sum Channel RF | Difference Channel RF |
| Vertically Polarized Return | $1.41\sin\omega t\left[\cos\left(\frac{d}{2}\sin\Theta\right)\right]$ | $1.41\cos\omega t\left[\sin\left(\frac{d}{2}\sin\Theta\right)\right]$ |
| Horizontally Polarized Return | $-1.41\sin\omega t\left[\sin\left(\frac{d}{2}\sin\Theta\right)\right]$ | $-1.41\cos\omega t\left[\cos\left(\frac{d}{2}\sin\Theta\right)\right]$ |

As can be observed from the table, the total far field pattern of the flatplate array with the split polarizer lens is linearly polarized upon transmission, with a polarization vector whose orientation varies according to the elevation depression angle θ. 3 dB of radiated power is lost by using the lens when transmitting through lower and upper half apertures simultaneously. However, the radar system is then sensitive to both horizontally and vertically polarized returns.

Two polarimetric modes are possible in the baseline RF configuration of FIG. 1. First, one can transmit from the full aperture (linear polarization, vertical on elevation boresight); receive at sum and elevation difference ports (vertical and horizontal linear polarization respectively on elevation boresight). Isolation between the two orthogonal receive polarizations is more than 30 dB on boresight. A background system-level RF injection capability maintains the gain balance and phase alignment between the co- and cross-pol channels at approximately 0.1 dB and 1.0° respectively.

Alternatively, one could transmit from the upper half aperture only (right-hand circular polarization) and receive at upper and lower aperture ports (right- and left-hand circular polarizations), which are connected to the sum and elevation difference receivers, respectively.

In order to support interferometric applications while maintaining weather penetration, the three interferometers, part of the AN/APG-76 antenna, should be covered by a lens as well. For maximum separation of aperture phase centers, they should work in conjunction with the upper half of the monopulse array, and should therefore be like-sense polarized (right-hand circular).

Another configuration, illustrated in FIG. 9, would create a fully polarimetric system. This embodiment is similar to the system shown in FIG. 1, having many of the same components which bear the same reference numbers. This system requires a pair of RF switches, SW1 and SW2, as well as slight modification to the waveguide runs. A fully polarimetric linear system is defined as one which transmits alternately Vertical and Horizontal polarization, and receives both Vertical and Horizontal (HH, VV, HV). A fully polarimetric circular system is defined as one which transmits alternately right-hand and left-hand circular polarization, and receives both right- and left-hand circular (RL, LR). Right-hand circular is abbreviated R and left-hand circular is L, while linear vertical is V and linear horizontal, H. Table II lists the modes possible with the various switch positions.

TABLE II

Possible Modes of Operation With Fully Polarimetric Monopulse Aperture

| SW1 | SW2 | MODES |
|---|---|---|
| 1–2, 3–4 | 1–2, 3–4 | Transmit V on boresight, receive colinear at Sum Rcvr; receive orthogonal linear at El Difference Rcvr. |
| 1–2, 3–4 | 1–4, 2–3 | Transmit H on boresight, receive colinear at Sum Rcvr; receive orthogonal linear at El Difference Rcvr. |
| 1–4, 2–3 | 1–2, 3–4 | Transmit R, receive R at Sum Rcvr, receive L at El Difference Rcvr. |
| 1–4, 2–3 | 1–4, 2–3 | Transmit L, receive L at Sum Rcvr, receive R at El Difference Rcvr. |

Although I have shown and described certain present preferred embodiments of my improved flatplate antenna and polarizing lens, it should be distinctly understood that my invention is not limited thereto but may be variously embodied within the scope of the following claims.

I claim:

1. An improved flatplate array antenna of the type comprised of an array for transmitting and receiving RF signals connected to at least one of a transmitter and a receiver wherein the improvement comprises a polarizer lens positioned adjacent the array and comprised of at least one dielectric sheet having an upper half and a lower half, each half containing a set of parallel meanderlines positioned so that vertically or horizontally polarized RF energy emitted from the array passes through the lens and undergoes one of a phase advance and a phase retard so that the RF energy passing through the upper half becomes circularly polarized in one direction and the RF energy passing through the lower half becomes circularly polarized in an opposite direction thereby enabling the antenna to receive and process both senses of circular polarization simultaneously and to simultaneously emit both senses of circular polarization.

2. The improved flatplate array antenna of claim 1 also comprising an RF switch connected between the array and at least one of a transmitter and a receiver.

3. The improved flatplate array antenna of claim 1 also comprising a pair of RF switches connected between the array and at least one of a transmitter and a receiver.

4. The improved antenna of claim 1 wherein the meanderlines are etched lines set at a 45-degree angle relative to a line separating the upper half from the lower half of the polarizer lens and etched lines in the upper half are not collinear with etched lines in the lower half.

5. The improved antenna of claim 1 wherein the polarizer lens is comprised of a plurality of stacked dielectric sheets each having an upper half and a lower half, each half containing a set of parallel etched lines, and the dielectric sheets are stacked so that the etched lines of adjacent sheets are aligned.

6. The improved antenna of claim 1 wherein one half of the polarizer lens twists vertically polarized energy from the array +45 degrees and the other half of the polarizer lens twists vertically polarized energy from the array −45 degrees.

7. The improved antenna of claim 1 wherein one half of the polarizer lens twists linear polarized energy from the array 90 degrees.

8. The improved antenna of claim 1 wherein one half of the polarizer lens imparts right-hand polarization to linear polarized energy from the array and the other half of the polarizer lens imparts left-hand polarization to linear polarized energy from the aperture.

9. The improved antenna of claim 1 wherein the array is a flat plate array.

10. A polarizer lens for an aperture comprised of at least one dielectric sheet having an upper half and a lower half, each half containing a set of parallel etched lines positioned so that when the lens is positioned adjacent the aperture vertically or horizontally polarized RF energy emitted from the aperture passes through the lens and undergoes one of a phase advance and a phase retard so that the RF energy passing through the upper half becomes circularly polarized in one direction and the RF energy passing through the lower half becomes circularly polarized in an opposite direction so that the lens passes both senses of circular polarization simultaneously.

11. The polarizer lens of claim 10 wherein the etched lines are set at a 45-degree angle relative to a line separating the upper half from the lower half of the polarizer lens and etched lines in the upper half are not collinear with etched lines in the lower half.

12. The polarizer lens of claim 10 wherein the polarizer lens is comprised of a plurality of stacked dielectric sheets each having an upper half and a lower half, each half containing a set of parallel etched lines, and the dielectric sheets are stacked so that the etched lines of adjacent sheets are aligned.

13. The polarizer lens of claim 10 wherein one half of the polarizer lens twists vertically polarized energy from the aperture +45 degrees and the other half of the polarizer lens twists vertically polarized energy from the aperture −45 degrees.

14. The polarizer lens of claim 10 wherein one half of the polarizer lens twists linear polarized energy from the aperture 90 degrees.

15. The polarizer lens of claim 10 wherein one half of the polarizer lens imparts right-hand polarization to linear polarized energy from the aperture and the other half of the polarizer lens imparts left-hand polarization to linear polarized energy from the aperture.

* * * * *